United States Patent [19]

Staniak et al.

[11] Patent Number: 4,616,616

[45] Date of Patent: Oct. 14, 1986

[54] FUEL CONTROL SYSTEM

[75] Inventors: Waldema A. Staniak, Geneva, Switzerland; Robert E. Samuelson, Washington; Michael E. Moncelle, Normal, both of Ill.

[73] Assignee: Caterpillar Inc., Peoria, Ill.

[21] Appl. No.: 527,043

[22] Filed: Aug. 29, 1983

[51] Int. Cl.[4] ..... F02M 39/00

[52] U.S. Cl. ..... 123/357; 123/373; 123/365

[58] Field of Search ..... 123/357, 358, 359, 372, 123/373, 365

[56] References Cited

U.S. PATENT DOCUMENTS

| | | | |
|---|---|---|---|
| 2,637,015 | 4/1953 | Franklin | 322/32 |
| 3,082,353 | 3/1963 | Cohen | 123/357 |
| 3,145,624 | 8/1964 | Parks | 123/357 |
| 3,249,098 | 5/1966 | Rosenberg | 123/357 |
| 3,438,361 | 4/1969 | Wagner | 123/357 |
| 3,918,318 | 11/1975 | Phillips | 123/198 DB |
| 4,090,480 | 5/1978 | Kasiewicz | 123/357 |
| 4,138,979 | 2/1979 | Taplin | 123/357 |
| 4,170,976 | 10/1979 | Eckert | 123/357 |
| 4,212,279 | 7/1980 | Ohanti | 123/357 |

FOREIGN PATENT DOCUMENTS

| | | | |
|---|---|---|---|
| 8216800 | 4/1983 | France | 123/372 |
| 1091453 | 11/1967 | United Kingdom | 123/373 |
| 1400299 | 7/1975 | United Kingdom | 123/357 |
| 2051416 | 1/1981 | United Kingdom | 123/372 |

OTHER PUBLICATIONS

Technical Bulletin No. EG 40-2—American Bosch, Feb. 1978.

Parts Catalog—Aeroflex Laboratories, Inc., Jul. 1973.

Motortechnische Zeitschrift—No. 42, pp. 323-324, Sep. 1981.

*Primary Examiner*—Carl Stuart Miller

*Attorney, Agent, or Firm*—Phillips, Moore, Lempio & Finley

[57] ABSTRACT

A fuel control system (10 or 70) includes a hydraulic servo system (17) for moving a fuel rack (15) in response to movement of a rack control member (16). A brushless direct current torque motor (50), having a rotor (51) and a control lever (53) fixed thereto, is arranged with its lever end (54) confined between opposed shoulders (41, 42) on the rack control member (16). Electronically energized movement of the rotor (51) and its control lever (53) in one direction, or spring (56) biased movement in the other, causes corresponding movement of the control member (16) and fuel rack (15). A second control lever (99), movable by a mechanical governor control (80), is engageable with another shoulder (104) on the rack control member (16) to move it in a fuel-decreasing direction. The present fuel control systems (10 and 70) are particularly useful in conjunction with a fuel injection pump (11) for a diesel engine (13) with the fuel flow rate being controlled in sole response (10) to an electronic engine control (60) or in dual response (70) to an electronic engine control (60) and a mechanical governor control (80).

22 Claims, 3 Drawing Figures

FIG. 1
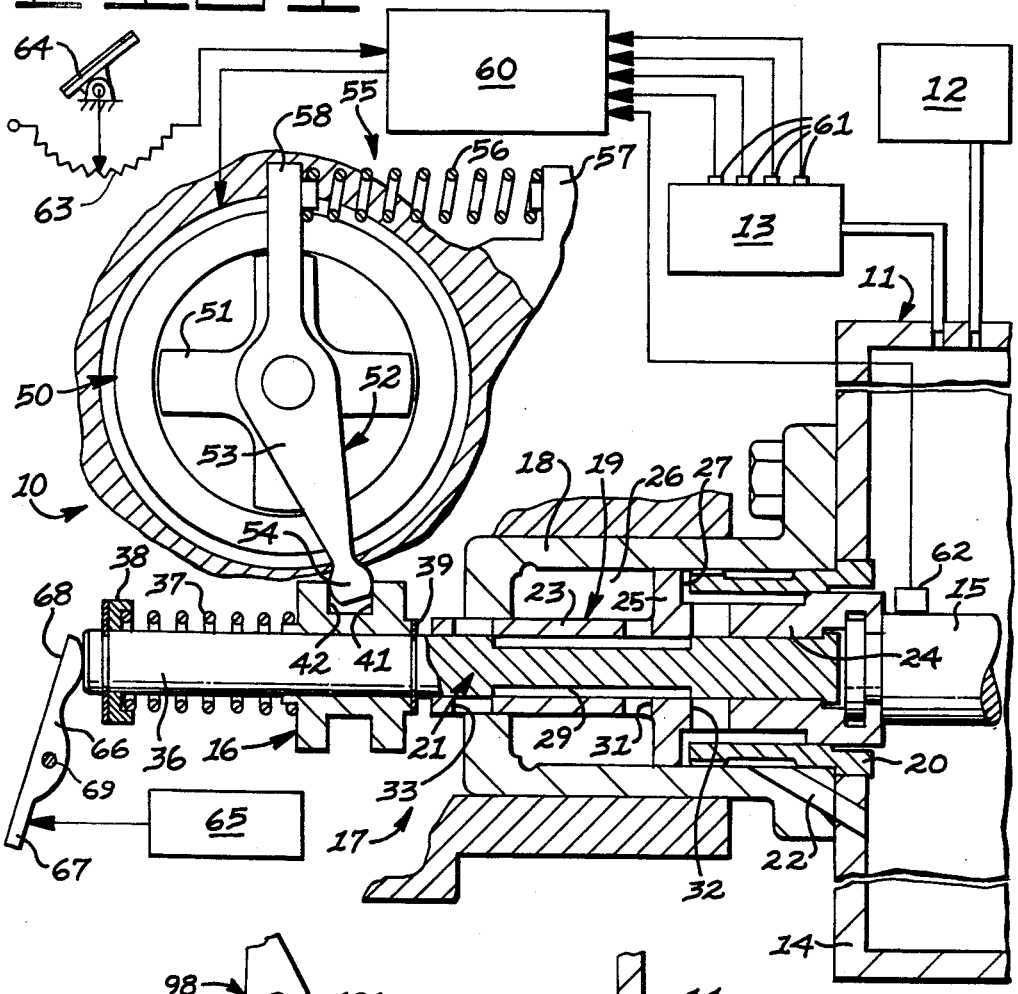
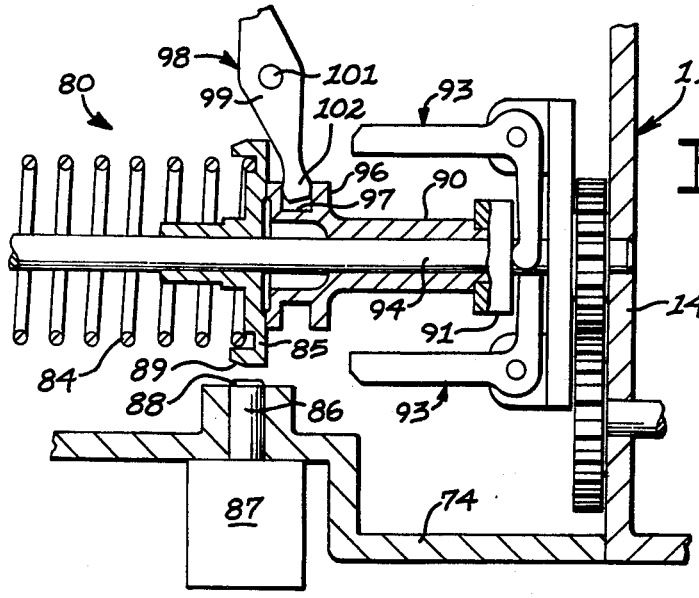
FIG. 3

FUEL CONTROL SYSTEM

DESCRIPTION

1. Technical Field

This invention relates to fuel control systems wherein a fuel injection pump delivers fuel to a diesel engine and more particularly to the actuating mechanism for moving the fuel rack of the fuel injection pump and maintaining it at a desired fuel delivery position.

2. Background Art

The operation of a diesel engine is controlled basically by varying the amount of fuel delivered to the engine by the fuel injection pump and by setting the time of fuel injection into the combustion cylinders relative to the time that the engine pistons reach top dead center during their compression strokes. In general, the amount of fuel injected into the combustion cylinders will control the speed of the engine and the time of injection will affect the efficiency of fuel combustion and engine operation.

In a fuel control system for a diesel powered engine, the fuel injection pump typically includes a movable fuel rack whose translational position determines the amount of fuel injected per stroke of the fuel injection pump, the fuel rack being under the control of a governor system which includes an operator-controlled throttle that enables the vehicle operator to change engine speed within the preset low-idle and high-idle limits and includes a mechanism responsive to engine speed which will automatically increase fuel injection to produce more power and increase the engine speed when an increased vehicle load causes the engine speed to decrease or vice versa.

If the governor system allows too much fuel to be injected during an engine piston stroke, causing incomplete fuel combustion, as may occur when the vehicle operator quickly increases the throttle setting, a considerable amount of smoke and emissions may be present in the engine exhaust which exceed the smoke and emission standards set by federal and/or state governments.

In order to meet the smoke and emission standards, electronic engine controls have been and are being developed which monitor changing engine conditions and determine from such conditions the instantaneous optimum allowable amount of fuel to be injected into the engine. Such controls generate electrical signals to be used in moving the fuel rack to the correct position and in maintaining the fuel rack at such position.

A problem presently exists in providing a mechanism which will be energized by such electrical signals from an electronic engine control and which will move the fuel rack in response to such electrical energization.

It may be also desirable to provide a fuel control system wherein a fuel rack is jointly controlled by an electronic engine control and by a conventional throttle actuated mechanical governor. For example, an electronic engine control may be designed as a rack limit control, allowing the fuel rack to be controlled in response to a conventional mechanical governor as long as the position of the fuel rack is below the allowable limit determined by the electronic engine control. In such case, the system will function so that the electronic engine control takes over and prevents the mechanical governor from moving the fuel rack beyond such limit.

Or, the electronic engine control may be designed for primary actuation of the fuel rack, with the mechanical governor controlling the limits of engine speed and preventing the electronic engine control from moving the fuel rack beyond such limits.

A problem presently exists in providing a fuel control system which provides easy and smooth movement and positioning of the fuel rack when independently controlled by an electronic engine control and by a mechanical governor, with control of the fuel rack alternating back and forth from one control to the other as needed.

A further problem exists in providing a fuel control system which will readily enable the fuel rack to be actuated in response to a mechanical governor control up to a rack limit set by an electronic engine control or which will enable the fuel rack to be actuated in response to an electronic engine control up to a speed limit set by a mechanical governor control.

Another problem exists in providing a fuel control system which is compatible with existing mechanical governing mechanisms and which will allow easy conversion of an existing fuel control system having a mechanical governing system to a fuel control system having a mechanical and electronic dual control of rack movement.

A further problem exists in providing a fuel control system which will cause movement of the fuel rack to shut off fuel flow in the event of failure of the electronic engine control when such control is used alone for fuel rack control.

Another problem exists in providing a fuel control system utilizing a joint control by an electronic engine control and a mechanical governor control which will allow limp-home control of the fuel rack by the mechanical governor control, but at a reduced fuel delivery position, in the event of failure of the electronic engine control.

DISCLOSURE OF THE INVENTION

The present invention is directed to overcoming one or more of the problems set forth above.

In one aspect of the invention, a fuel control system is provided having a movable fuel rack, a movable rack control member, a servo system for moving the fuel rack in response to movement of the rack control member, a brushless torque motor having a rotor which will rotate in response to electrical energization and a coupling means for connecting the rotor to the rack control member for movement of the rack control member by the rotor of the torque motor.

In a further aspect of the invention as just described, the torque motor is arranged to move the rack control member in a fuel-increasing direction in response to electrical energization, and a bias means is provided to bias the rack control member in a fuel-decreasing direction.

In another aspect of the invention, a dual-controlled fuel system is provided having a movable fuel rack, a movable rack control member, and a servo system for moving the fuel rack in response to movement of the rack control member. In this fuel system, an electronic engine control and a mechanical governor control are provided, each having a member movable independently of each other in fuel-increasing and fuel-decreasing directions. First and second coupling means connect the movable members of the electronic engine control and mechanical governor control to the rack control member for movement thereof.

In a further aspect of the invention, the above described dual-controlled fuel system is arranged so that which ever movable member of the electronic engine control or the mechanical governor control is calling for the least fuel delivery position of the fuel rack will act on the rack control member to move the fuel rack to said least position, while the other movable member acts independently for limiting movement of the fuel rack in a fuel-increasing direction.

Yet another dual-control aspect of the invention is that the movable member of the electronic engine control will, when electrically energized, urge the rack control member in a fuel-decreasing direction, with a bias means being provided to urge the rack control member to move in a fuel-increasing direction. In event of failure of the electronic engine control, the bias means will enable the rack control member to be controlled solely by the movable member of the mechanical governor control and a limit means is provided to limit movement of the movable member of the mechanical governor control in a fuel-increasing direction upon such failure of the electronic engine control.

The foregoing and other aspects will become apparent from the following detailed description of the invention when considered in conjunction with the accompanying drawings.

BRIEF DESCRIPTION OF THE DRAWINGS

FIG. 1, partly in block diagrammatic form and partly in sectional detail, illustrates a fuel control system and rack control member thereof utilizing the present invention and wherein the rack position is controlled solely by an electronic engine control.

FIG. 3 is a detail of FIG. 2 illustrating the position of parts of the mechanical governor control during normal operation.

DESCRIPTION OF THE PREFERRED EMBODIMENT

Figure 2:
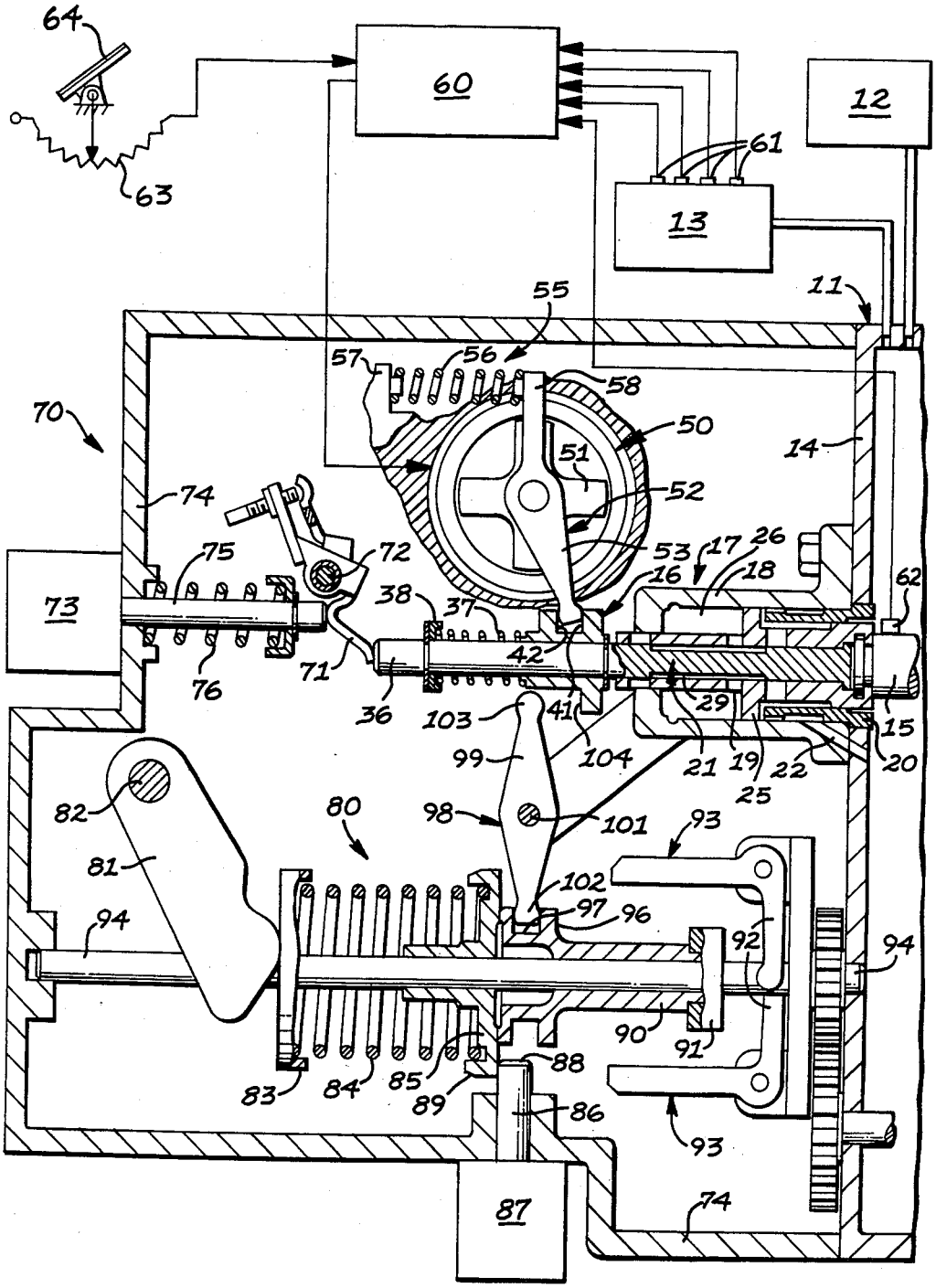
FIG. 2, partly in block diagrammatic form and partly in sectional detail, illustrates a fuel control system and rack control member thereof and wherein the rack position is controlled alternately by an electronic engine control or a mechanical governor control.

Referring now to the embodiment of the invention shown in FIG. 1, the fuel control system 10 includes a fuel injection pump 11 for pressurizing and metering the amount of fuel delivered from a fuel tank 12 to the combustion cylinders of an internal combustion engine 13. As is conventional, the fuel injection pump 11 includes a fuel injection pump housing 14 and a reciprocating fuel rack 15 which is axially movable in opposite fuel-increasing and fuel-decreasing directions (shown in FIGS. 1, 2 and 3 as being to the left and to the right, respectively).

The fuel control system 10 further includes a rack control member 16 which is movable in opposite fuel-increasing and fuel-decreasing directions. In the particular system illustrated herein, the rack control member 16 is in the form of an annular sleeve or collar. A hydraulic servo system 17 is further provided to function as a means for moving the fuel rack 15 in its fuel-increasing and fuel-decreasing directions in response to corresponding fuel-increasing or fuel-decreasing movements of the rack control member 16 and with a force greater than that required to move the rack control member 16. The hydraulic servo system 17 particularly illustrated herein includes a cylinder 18, a piston 19, a sleeve 20 and a pilot valve spool 21.

The cylinder 18 is secured to the fuel injection pump housing 14 and has a passage 22 communicating with the interior of the pump housing 14 through which pressurized engine lubricating oil may flow. The piston 19, which is ported and stepped and connected to the fuel rack 15 for axial movement therewith, is disposed for axial movement in the cylinder 18. The diameter of the left end 23 of the piston 19 is less than the diameter of the right end 24 of the piston which slides in the sleeve 20 fixed within the cylinder 18, and both such diameters are less than that of the intermediate piston head 25. The left end 23 of the piston, the piston head 25 and the cylinder 18 define an annular chamber 26. The piston head 25 has an annular surface 27 on the right side thereof.

The pilot valve spool 21 is mounted within the piston 19 for limited axial movement relative thereto, the pilot valve spool 21 having a reduced diameter recess 29 in continuous communication with piston ports 31. The axial length of recess 29 is sized relative to piston ports 32 and 33 such that recess 29 does not communicate with either of the piston ports 32 or 33 when the pilot valve spool 21 is in the balanced position of FIG. 1, but will communicate with the piston ports 32 or 33 when moved to the right or the left respectively relative to the piston 19.

The rack control member 16 is mounted for limited axial sliding movement on the left end stem 36 of the pilot valve spool 21. The rack control member 16 is biased towards the right by a spring 37 which shoulders against a spring retainer 38, with rightward movement of the rack control member 16 being limited by a retainer clip 39 which is fixed to the pilot valve spool stem 36. The rack control member 16 has a pair of radially extending flanges on one side thereof to provide a pair of oppositely facing shoulders 41 and 42.

An electrically energizable brushless direct current torque motor 50 is mounted in fixed relation to the cylinder 18 of the servo system 17, the motor 50 having a rotatable rotor 51 movable in opposite fuel-increasing and fuel-decreasing directions. It is a functional characteristic of such a torque motor that its rotor will turn freely in its bearings when no electrical current is supplied to the motor. When electrical current is applied, the rotor will exert a preselected torque in one direction, the degree of torque being proportional to the amount of the current applied. A "brushless direct current torque motor" is also known as a "proportional rotary solenoid," or a "proportional rotary actuator."

A coupling means 52 is provided for connecting the rotor 51 of the torque motor 50 to the rack control member 16 to move the rack control member 16 in one of its fuel-increasing or fuel-decreasing directions in response to movement of the rotor 51 in its corresponding fuel-increasing or fuel-decreasing direction. In the particular system shown herein, the coupling means 52 comprises a control lever 53 fixed to the rotor 51 and having a free end 54 confined between the shoulders 41 and 42 of the rack control member 16.

In the system illustrated in FIG. 1, the torque motor 50 is arranged so that current applied thereto will cause a torque to be exerted on the control lever 53, urging it to move in a clockwise, fuel-increasing direction, in turn urging the rack control member 16 in its leftward, fuel-increasing direction. A bias means 55 is provided for biasing the rack control member 16 in a direction opposite to the direction that the coupling means 52 will move the rack control member 16 when the torque motor 50 is energized. In the particular fuel control system 10 shown in FIG. 1, the bias means 55 comprises a low rate compression spring 56 confined between a fixed spring seat 57 and an extension 58 of the control lever 53. With this arrangement, the spring 56 biases control lever 53 in its fuel-decreasing direction, with the free end 54 of control lever 53 acting on the shoulder 41 of the rack control member 16 to bias such rack control member 16 for movement in its fuel-decreasing direction.

The fuel control system 10 of FIG. 1 also includes an electronic engine control 60 which processes information from the engine operation sensors 61, the rack position sensor 62, and throttle position sensor 63, and generates a rack control signal which is applied to torque motor 50. For example, the engine operation sensors 61 may monitor engine speed, fuel injection timing angle, atmospheric pressure, lubricating oil pressure, fuel temperature, coolant temperature, atmospheric temperature, and intake manifold or boost pressure. The rack position sensor 62 may be in the form of a potentiometer having its wiper arm driven by fuel rack movement or, alternatively the rack position sensor 62 may be an induction-type transducer. The throttle position sensor 63 may be in the form of a potentiometer having its wiper arm driven by movement of a foot-actuated throttle pedal 64.

Since the particular design of the electronic engine control 60 forms no part of the present invention, the specific details thereof have not been shown. As far as the present disclosure is concerned, it is necessary only that such electronic engine control 60 output a predetermined level of current to torque motor 50 to move the rack control member 16 to a desired position which is balanced by the spring 56.

A shut-down solenoid 65 and pivotal lever 66 are mounted in operational relation to the hydraulic servo system 17 so that the solenoid plunger can engage one end 67 of the pivotal lever 66, the other end 68 of the pivotal lever 66 being engageable with the stem 36 of the pilot valve spool 21. The solenoid 65 is arranged so that during normal engine operation, the solenoid 65 is energized and its plunger is retracted to the right. When the solenoid is deenergized, an internal spring (not shown) will move the plunger to the left, as indicated by the arrow, to engage lever end 67 so that lever 66 will pivot in a clockwise direction to cause pilot valve spool 21 to move in a fuel-decreasing direction. Shaft 69, on which lever 66 is fixed, may be manually rotated in a clockwise direction to provide a manual fuel shut-down capability.

The fuel control system of FIG. 2 uses the same hydraulic servo system 17 to cause movement of the fuel rack 15 in response to movement of the rack control member 16 as described above, but utilizes a combined operation of an electronic engine control and a mechanical governor control to set the position of the fuel rack 15.

The electronic portion of the fuel control system 70 of FIG. 2 is generally similar to the electronic portion of the fuel control system 10 of FIG. 1, in that the rotor 51 of the brushless torque motor 50 is movable in opposite fuel-increasing and fuel-decreasing directions and is urged to move in one of its directions upon energization of the torque motor 50, and the coupling means 52 connects the rotor 51 of the torque motor to the rack control member 16 to move the rack control member in one of its fuel-increasing or fuel-decreasing directions in response to movement of the rotor 51 in its corresponding fuel-increasing or fuel-decreasing direction. Likewise, the bias means 55 functions to bias the rack control member 16 to move in a direction opposite to the direction that the coupling means 52 will move the rack control member 16 when the torque motor 50 is energized.

The electronic portion of the fuel control system 70 of FIG. 2 differs from that previously described in connection with FIG. 1 in that the electronic engine control 60 of FIG. 2 is programmed so that an energizing signal applied to the torque motor 50 will urge its rotor 51 and lever arm 53 to rotate in a counterclockwise, fuel-decreasing direction, against the bias force of the bias means 55 and spring 56 thereof, the latter being arranged to bias lever arm 53 in a clockwise, fuel-increasing direction.

A manually-operable fuel shut-down lever 71, rotatable about the axis of shaft 72, is provided to engage the end of pilot valve spool 21 and move it to the right when it is desired to shut off fuel flow to engine 13. Preferably, a shut-down solenoid 73 is mounted on governor housing 74 with its plunger 75 being in the path of movement of shut-down lever 71. Solenoid 73 is energized during normal engine operation so that its plunger 75 is moved to the left and held out of the way of normal movement of the pilot valve spool 21. In the event of loss of electrical power, the shut down solenoid 73 will deenergize and spring 76 will move plunger 75 to the right, urging lever 71 to the right and causing the pilot valve spool 21 and the fuel rack 15 to move to the fuel-shut-off position. The bias force of shut down solenoid spring 76 is, of course, sufficiently greater than the bias of torque motor spring 56 to enable such shut down of fuel.

The mechanical governor control 80 shown herein includes an operator controlled throttle lever 81 pivoted about the axis of shaft 82 and movable against spring seat 83. A speeder spring 84 is confined between the speeder spring seats 83 and 85 and urges the speeder spring seat 85 to the right. As shown in FIG. 2, rightward movement of the speeder spring seat 85 is limited by engagement with the plunger 86 of the solenoid 87. The plunger 86 has a rounded end 88, and the speeder spring seat 85 has a tapered surface 89.

The solenoid 87 is arranged so that, during normal operation of the electronic engine control 60, it will be energized and its plunger 86 will be retracted to the position shown in FIG. 3, out of the path of movement of the speeder spring seat 85. The mechanical governor control 80 includes a riser member 90 movable in opposite fuel-increasing and fuel-decreasing directions (shown in FIGS. 2 and 3 as being to the right and to the left, respectively). With the solenoid 87 energized to retract its plunger 86, the speeder spring 84 is free to bias the riser member 90 to the right so that the thrust member 91 engages the arms 92 of the pivotal flyweights 93. The flyweights are driven around the axis of the shaft 94, in a conventional manner and at a speed proportional to engine speed, so that as the engine speed increases, the riser member 90 will move in its fuel-decreasing direction, i.e. to the left in FIGS. 2 and 3, against the force of speeder spring 84. The riser member 90 has an integral collar 96 with an annular groove 97 therearound.

A coupling means 98 is provided for connecting the mechanical governor control 80 to the rack control member 16 to move the rack control member 16 in a fuel-decreasing direction in response to movement of the riser member 90 in its fuel-decreasing direction. In the particular system shown, the coupling means 98 comprises a control lever 99 mounted for pivotal movement about the fixed axis of shaft 101, with one end 102 of the control lever 99 disposed in the riser collar groove 97 and the other end 103 of the control lever 99 being in the path of movement of the shoulder 104 on the rack control member 16.

INDUSTRIAL APPLICABILITY

The hydraulic servo system 17 shown in FIGS. 1 and 2 operates as follows. If rack control member 16 is moved to the left from the position illustrated in the figures, it will urge the spring 37, spring retainer 38, and the slidable pilot valve spool 21 to the left. Such movement moves the valve spool recess 29 leftward relative to the piston 19 so that the piston ports 31 communicate with the piston ports 33 to allow oil to drain from the annular chamber 26 to the left of the piston head 25. Oil entering the cylinder 18 through the passage 22 and being pressurized by the engine 13 will then effectively act upon the annular surface 27 of the piston head 25, forcing the piston 19 and the fuel rack 15 to move leftwardly in a fuel-increasing direction. When the piston 19 moves sufficiently to the left, so that the pilot valve recess 29 is blocked from communicating oil to the piston ports 33, fuel rack movement will cease.

Movement of the rack control member 16 to the right will, by engagement of the rack control member 16 against the retainer clip 39, move the pilot valve spool 21 to the right, so that the valve spool recess 29 puts the piston ports 31 and 32 into communication with each other. This enables pressurized oil to flow into the annular chamber 26 so that the piston 19 and the fuel rack 15 are forced rightwardly in a fuel-decreasing direction. When the piston 19 has moved sufficiently to the right so that fluid communication between the piston ports 32 and spool recess 29 is blocked, the piston 19 will assume a hydraulically balanced position until such time as the pilot valve spool 21 is moved from its balanced position relative to the piston 19.

In the fuel control system 10 of FIG. 1, the electronic engine control 60 will process the various signals from the engine operation sensors and make a determination as to the desired position to which fuel rack 15 should be set for optimal maximum amount of fuel injection under the existing conditions, without having the engine exhaust exceed predetermined levels of smoke and noxious emissions. The electronic control then outputs a predetermined level of current to the torque motor 50 to move the rack control member 16 to a desired position which is balanced by spring 56. The hydraulic servo system 17 then functions, as described above, to move the fuel rack 15 to the position determined by the new position of the rack control member 16. The actual position of the fuel rack 15, sensed by the rack position sensor 62, is compared in the electronic engine control 60 with the desired rack position, so that the output signal to the torque motor 50 is maintained at a level sufficient to maintain the rack control member 16 at the position necessary to keep the fuel rack 15 at the desired rack position.

The hydraulic forces on the pilot valve spool 21 are balanced at all times so that only a relatively low level of force is required from the torque motor 50 to move the rack control member 16 and to hold such member at a desired position against the opposing force of the spring 56.

In case of failure of the electronic engine control 60, the current to torque motor 50 will urge its control lever 53 to rotate in a counterclockwise direction. Such bias will move the rack control member 16 to the right, causing the fuel rack 15 to move in its fuel-decreasing direction. Such movement will continue until the fuel rack 15 has moved to a fuel shut off position.

In the event of failure of the vehicle electrical system, or in the event that the vehicle operator causes the shut-down solenoid 65 to be disconnected from the electrical system, the deenergization of the solenoid 65 will cause the pilot valve spool 21 to move to the right, in turn causing the fuel rack 15 to be moved to a fuel shut off position.

The operation of the fuel control system 70 when both the electronic engine control 60 and the mechanical governor control 80 are functioning will depend upon the particular programming of the electronic engine control used in the system.

For example, the electronic engine control 60 may be programmed to function as a rack limit device, with primary control of rack position being by the mechanical governor control 80. In such case, the electronic engine control 60 could be programmed so that no current is applied to the torque motor 50 as long as the fuel rack 15 is at a fuel delivering position less than the maximum position determined by the electronic engine control. In such case, with no current applied to the torque motor 50, its rotor 51 is free to rotate and the spring 56 will urge the rack control member 16 to the left so that the rack control shoulder 104 engages the end 103 of the control lever 99. Then, movement of the riser member 90, in its fuel-increasing or fuel-decreasing direction, in response to the opposing forces of the speeder spring 84 and the flyweights 93, will be coupled to the rack control member 16 by control lever 99 to cause the rack control member 16 to move in a corresponding fuel-increasing or fuel-decreasing direction.

In the event that the mechanical governor control 80 seeks to move the fuel rack 15 in its fuel-increasing direction to a position wherein the maximum allowable fuel delivery rate determined by the electronic control will be exceeded, the electronic engine control 60 will output a signal to the torque motor 50 to generate sufficient opposing torque to prevent further movement of the rack control member 16 in its fuel-increasing direction. The end 103 of the control lever 99 of the mechanical governor control 80 can continue to move in its fuel-increasing direction because the control lever end 103 is free to move leftwardly relative to the shoulder 104 on the rack control member 16.

Subsequent movement of the end 103 of the control lever 99 in its fuel-decreasing direction will enable the mechanical governor control 80 to regain control of fuel rack movement when the fuel rack position sought by the mechanical governor control 80 is less than the maximum allowable limit set by the electronic engine control 60.

Alternatively, the fuel control system 70 can function with the electronic engine control 60 being programmed to provide primary rack actuation and with the mechanical governor control 80 being used as a rack limit device.

In such case, as long as the mechanical governor control moves its control lever 99 to a position out of engagement with the shoulder 104 of the rack control member 16, rack position will be determined by the degree of energization of the torque motor 50 by the electronic engine control 60. If less fuel is desired, the torque of the motor 50 will increase to move the rack control member 16 in its fuel-decreasing direction. If more fuel is desired, the torque of the motor 50 will be decreased so that the spring 56 will move the rack control member 16 in its fuel-increasing direction. If the electronic engine control 60 seeks a greater fuel rate than the maximum amount allowed by the mechanical governor control, the shoulder 104 of the rack control member 16 will engage the end 103 of control level 99 and further movement of the rack control member 16 will be prevented. The forces exerted on the control lever 99 by the mechanical governor control 80 are sufficient to stop movement of the rack control member 16 by the spring 56 in its fuel-increasing direction when the shoulder 104 engages the control lever 99.

The electronic engine control 60 will again take over control when the electronic engine control calls for a rack position less than that allowed by the mechanical governor control 80.

As may be seen, the dual control fuel control system of FIG. 2, with both of the control levers 53 and 99 operating independently of each other but both acting on the same rack control member 16, enables a sure, smooth and simple switch over from mechanical governing to electronic governing, and vice versa.

Additionally, the disclosed dual control system allows the same hardware to be used for rack limiting or rack actuating by the electronic engine control 60.

The dual control system of FIG. 2 is also advantageous in vehicle use in that it enables a limited, limp-home operation of the engine in case of failure of the electronic control, so that the operator can move the vehicle to a service facility for repair.

If the electronic control fails, the torque motor 50 will be deenergized and the spring 56 will bias the control lever 53 in a fuel-increasing direction so that the shoulder 104 of the rack control member 16 comes into engagement with the control lever 99. At the same time, the solenoid 87 will be deenergized so that its plunger 86 will move upwardly by a conventional internal spring means (not shown).

If, at the time of electronic engine control failure, the speeder spring seat 85 of the mechanical governor had been in a minimum fuel delivery position to the left of the solenoid plunger 86, then such plunger would be free to move fully upwardly so that it will limit rightward movement of the speeder spring seat 85 therepast, and thereby limit movement of the fuel rack 15 in its fuel-increasing direction.

If the speeder spring seat 85 had been in a fuel delivery position to the right of the solenoid plunger 86, an increase in engine speed will cause the flyweights 93 to force the riser member 90 to the left, in its fuel-decreasing direction. The rounded end 88 of the solenoid plunger 86 will engage the tapered surface 89 of the speeder spring seat 85 so that the plunger 86 will be cammed downwardly as the speeder spring seat 85 is moved leftwardly by the flyweight force. When the speeder spring seat 85 clears the plunger 86, the plunger will move upwardly to limit subsequent movement of the speeder spring seat 85 in its fuel-increasing direction.

The engine may now be operated with the mechanical governor functioning with a part load maximum fuel delivery setting to provide a limp-home mode.

As is apparent from the preceding description, substantially the same hardware is used for the electronic control of the rack control member 16 in the fuel control system 10 of FIG. 1 or the fuel control system 70 of FIGS. 2 and 3. As a consequence, the same basic hardware components of the electronic control can be used in a system wherein the fuel rack is controlled only by an electronic engine control or in a dual control system wherein the fuel rack is controlled electronically or mechanically.

The present invention is also very advantageous in that the torque motor 50 can be programmed or positioned to exert torque in a fuel-increasing direction or in a fuel-decreasing direction. Likewise, the bias means 55 can easily be arranged to bias the rack control member 16 in either a fuel-decreasing or a fuel-increasing direction, or the bias may be omitted altogether. As a consequence, the programming of the electronic engine control 60 may be widely varied to provide different desired methods of control of fuel rack positioning.

The present fuel control system 70 with its dual electronic and mechanical control has a number of advantages in overall engine control, in addition to those previously mentioned.

For example, the electronic engine control 60 can be easily programmed to respond to an engine overspeed condition or to an excessive ground speed condition and to cut back the fuel to the engine from the amount called for by the mechanical governing mechanism.

Further, in conventional fuel control systems, electro-mechanical control valves and hydraulic servo cylinders are used to provide rack limiting. The present dual control of the rack control member 16 eliminates the need for such components. Additionally, the present invention also eliminates the need for the normally required rack position limit stops. Such elimination of components, of course, results in a desirable reduction in hardware cost.

Such elimination also reduces considerably the overall physical size of the fuel rack control package, thereby reducing many fitting problems in the design of new equipment and also enabling easy conversion of an existing fuel control system having a mechanical governor alone to a dual control system which also incorporates electronic governing.

The present invention also has industrial applicability in that with the electronic engine control 60 being used to set rack limit, it is very difficult for the engine operator to tamper with the rack limit setting, thus making the fuel control system more acceptable to environmental regulatory agencies.

We claim:

1. A fuel control system (70) comprising:

a fuel rack (15) movable in opposite fuel-increasing and fuel-decreasing directions;

a rack control member (16) movable in opposite fuel-increasing and fuel-decreasing directions;

servo system means (17) for moving said fuel rack in response to movement of said rack control member (16);

an electrically energizable member (51) movable in opposite fuel-increasing and fuel-decreasing directions, said electrically energizable member (51) being urged to move in its fuel-decreasing direction when energized;

first coupling means (52) for connecting said electrically energizable member (51) to said rack control member (16) to move said rack control member (16) in its fuel-decreasing direction in response to movement of said electrically energizable member (51) in its fuel-decreasing direction;

a mechanical governor control (80) having a member (90) movable in opposite fuel-increasing and fuel-decreasing directions;

second coupling means (98) for connecting said mechanical governor (80) to said rack control member (16) to move said rack control member (16) in its fuel-decreasing direction in response to movement of said mechanical governor member (90) in its fuel-decreasing direction, said second coupling means having the further functions of allowing the position of said rack control member (16) to be controlled solely by said electrically energizable member (51) when said electrically energizable member (51) has been urged to move by the energization thereof to a position calling for less fuel than the position of said mechanical governor member (90), and of enabling the position of said rack control member (16) to be controlled by said mechanical governor member (90) when said mechanical governor member (90) is at a position calling for less fuel than the position to which said electrically energizable member (51) has been urged by the energization thereof;

bias means (55) for biasing said rack control member (16) to move in its fuel-increasing direction.

2. A fuel control system (70) as set forth in claim 1, wherein said rack control member (16) has first and second shoulders (41, 104) thereon both facing in the direction of fuel-increasing movement of the rack control member (16), wherein said first coupling means (52) includes a first control lever (53) movable by said electrically energizable member and having an end (54) engageable with said first shoulder (41), and wherein said second coupling means (104) includes a second control lever (99) movable by said mechanical governor member (90) and having an end (103) engageable with said second shoulder (104).

3. A fuel control system (70) as set forth in claim 2 wherein said rack control member (16) has a third shoulder (42) spaced from and facing said first shoulder (41), and wherein said end (54) of said first control lever (53) is confined between said first and third shoulders (41, 42).

4. A fuel control system (70) as set forth in claim 2 wherein said second coupling means (98) has the further function of holding said rack control member (16) against being moved in its fuel-increasing direction by said bias means (55) when said second control lever (99) is in engagement with said second shoulder (104) on said rack control member (16).

5. A fuel control system (70) as set forth in claim 1 and further including:

electronic control means (60) for energizing said electrically energizable member (51), means (85, 87) for limiting movement of said movable member (90) of said mechanical governor control (80) in a fuel-increasing direction upon deenergization of said electronic control means (60).

6. A fuel control system (70) as set forth in claim 1 wherein said electrically energizable member (51) is the rotor of a brushless torque motor (50).

7. A fuel control system (70) as set forth in claim 6, wherein said rack control member (16) has first and second shoulders (41, 104) both facing in the direction of fuel-increasing movement of said rack control member (16), wherein said first coupling means (52) includes a first control lever (53) fixed to said rotor (51) and having an end (54) engageable with said first shoulder (41), and wherein said second coupling means (98) includes a second control lever (99) movable by said mechanical governor member (90) and having an end (103) engageable with said second shoulder (104).

8. A fuel control system (70) as set forth in claim 7 wherein said rack control member (16) has a third shoulder (42) spaced from and facing said first shoulder (41) thereon, and wherein said end (54) of said first control lever (52) is confined between said first and third shoulders (41, 42).

9. A fuel control system (70 as set forth in claim 7 wherein said second coupling means (98) has the further function of holding said rack control member (16) against being moved in a fuel-increasing direction by said bias means (55) when said second control lever (99) is in engagement with said second shoulder (104) of said rack control member (16).

10. A fuel control system (70) as set forth in claim 6 and further including:

electronic control means (60) for energizing said rotor of said torque motor (51);

means (85, 87) for limiting movement of said movable member (90) of said mechanical governor control (80) in a fuel-increasing direction upon deenergization of said electronic control means (60).

11. A fuel control system (10 or 70) comprising:

a fuel rack (15) movable in opposite fuel-increasing and fuel-decreasing directions;

a rack control member (16);

servo system means (17) for moving said fuel rack (15) in response to movement of said rack control member (16) and with a force greater than that required to move said rack control member (16), said rack control member (16) being mounted on the servo system means (17) for limited axial sliding movement in opposite fuel-increasing and fuel-decreasing directions;

an electrically energizable brushless torque motor (50) having a rotor (51) movable in opposite fuel-increasing and fuel-decreasing directions, said rotor (51) being urged to move in one of its directions upon energization of said motor (50);

coupling means (52) for connecting said rotor (51) to said rack control member (16) to move said rack control member (16) in one of its directions in response to movement of said rotor (51) in its corresonding direction;

spring means (37) connected between the rack control member (16) and the servo system means (17) for resiliently providing relative movement between the servo system means (17) and the rack control member (16) whenever the rack control member (16) assumes a stationary fuel delivery position and the servo system mean (17) is moved in its fuel-decreasing direction;

bias means (55) for biasing said rack control member (16) to move in a direction opposite to the direction that said coupling means (52) will move said rack control member (16) when said torque motor (50) is energized;

sensor means (62) for sensing the position of said fuel rack (15);

electronic control means (60) for energizing said torque motor (50) with sufficient force to balance the force of said bias means (55) when said sensor means (62) senses that said fuel rack (15) is at a desired position; and, fuel shutoff means (66 or 71) for directly moving the servo system means (17) and the fuel rack (15) to a fuel shutoff position.

12. A fuel control system (10) as set forth in claim 11, wherein said rotor (51) of said torque motor (50) is urged to move in its fuel-increasing direction when said torque motor (50) is electrically energized and wherein said bias means (55) biases said rack control member (16) in its fuel-decreasing direction.

13. A fuel control system (70) as set forth in claim 11 and further including:

a mechanical governor control (80) having a member (90) movable in opposite fuel-increasing and fuel-decreasing directions;

a second coupling means (98) for connecting said mechanical governor member (90) to move said rack control member (16) in its said one direction in response to movement of said mechanical governor member (90) in its corresponding direction.

14. A fuel control system (70) as set forth in claim 13, wherein said rotor (51) of said torque motor (50) is urged to move in its fuel-decreasing direction when said torque motor (50) is electrically energized and wherein said bias means (55) biases said rack control member (16) in its fuel-increasing direction.

15. A fuel control system (70) comprising:

a fuel rack (15) movable in opposite fuel-increasing and fuel-decreasing directions;

a rack control member (16) movable in opposite fuel-increasing and fuel-decreasing directions and having first and second shoulders (41,104) thereon and facing in the same direction;

servo system means (17) for moving said fuel rack (15) in response to movement of said rack control member (16) and with a force greater than that required to move said rack control member (16);

an electrically energizable brushless torque motor (50) having a rotor (51) movable in opposite fuel-increasing and fuel-decreasing directions, said rotor (51) being urged to move in one of its directions upon energization of said motor (50);

a first control lever (53) fixed to said rotor (51), said first control lever (53) having an end (54) engageable with said first shoulder (41) on said rack control member (16) to move said rack control member (16) in one of its directions in response to movement of said rotor (51) in its corresponding direction;

a mechanical governor control (80) having a member (90) movable in opposite fuel-increasing and fuel-decreasing directions;

a second control lever (99) actuated by said mechanical governor member (90), said second control lever (99) having and end (103) engageable with said second shoulder (104) on said rack control member (16) to move said rack control member (16) in its said one direction in response to movement of said mechanical governor member (90) in its corresponding direction.

16. A fuel control system (70) as set forth in claim 15, including coupling means (98) for enabling said end (103) of said second control lever (99) and said second shoulder (104) on said rack control member (16) to be moved away from each other.

17. A fuel control system (70) as set forth in claim 15 and further including bias means (55) for biasing said rack control member (16) to move in a direction opposite to the direction that said first control lever (53) will move said rack control member (16) when said torque motor (50) is energized.

18. A fuel control system (70) as set forth in claim 17, and further including:

sensor means (62) for sensing the position of said fuel rack (15);

electronic control means (60) fr energizing said torque motor (50) with sufficient force to balance the force of said bias means (55) when said sensor means (62) senses that said fuel rack (15) is at a desired position.

19. A fuel control system (70) as set forth in claim 18, wherein said rotor (51) of said torque motor (50) is urged to move in its fuel-decreasing direction when said torque motor (50) is electrically energized and wherein said bias means (55) biases said rack control member (16) in its fuel-increasing direction.

20. The fuel control system (10 or 70) of claim 11 wherein the servo system means (17) includes a piston (19) connected to the fuel rack (15) and a pilot valve spool (21) mounted within the piston (19) for limited axial movement relative thereto, said rack control member (16) being mounted for limited axial sliding movement on the pilot valve spool (21).

21. The fuel control system (10 or 70) of claim 11 wherein the rack control member (16) defines a shoulder (41) thereon and the coupling means (52) includes a control lever (53) fixed to the rotor (51) of the torque motor (50) and having a free end (54) engageable with the shoulder (41) of the rack control member (16).

22. The fuel control system (10 or 70) of claim 11 wherein said sensor means (62) has the function of directly sensing the actual position of said fuel rack (15).

* * * * *

UNITED STATES PATENT AND TRADEMARK OFFICE

CERTIFICATE OF CORRECTION

PATENT NO. : 4,616,616

DATED : October 14, 1986

INVENTOR(S) : Waldemar A. Staniak, Robert E. Samuelson, Michael E. Moncelle

It is certified that error appears in the above-identified patent and that said Letters Patent are hereby corrected as shown below:

Cover page after "[75] Inventors:", delete "Waldema" and insert --Waldemar--;

Column 3, line 3, delete "which ever" and insert --whichever--;

Column 12, line 18, delete "(70" and insert --(70)--;

lines 53-54, delete "corresonding" and insert --corresponding--; and line 61, delete "mean" and insert --means--.

Signed and Sealed this

Sixth Day of January, 1987

*Attest:*

DONALD J. QUIGG

*Attesting Officer*

*Commissioner of Patents and Trademarks*